US008638267B2

(12) United States Patent
Omuro et al.

(10) Patent No.: US 8,638,267 B2
(45) Date of Patent: Jan. 28, 2014

(54) PARABOLIC ANTENNA

(75) Inventors: Norihiko Omuro, Tokyo (JP); Nobuhiko Oguma, Tokyo (JP)

(73) Assignee: NEC Corporation, Tokyo (JP)

( * ) Notice: Subject to any disclaimer, the term of this patent is extended or adjusted under 35 U.S.C. 154(b) by 293 days.

(21) Appl. No.: 12/744,396

(22) PCT Filed: Dec. 5, 2008

(86) PCT No.: PCT/JP2008/072150
§ 371 (c)(1),
(2), (4) Date: May 25, 2010

(87) PCT Pub. No.: WO2009/072602
PCT Pub. Date: Jun. 11, 2009

(65) Prior Publication Data

US 2010/0245187 A1 Sep. 30, 2010

(30) Foreign Application Priority Data

Dec. 7, 2007 (JP) ..... 2007-317110

(51) Int. Cl.
*H01Q 19/13* (2006.01)

(52) U.S. Cl.
USPC ..... 343/781 R; 343/840; 343/912

(58) Field of Classification Search
USPC ..... 343/702, 781 R, 722, 840, 912
See application file for complete search history.

(56) References Cited

U.S. PATENT DOCUMENTS 3,740,755 A * 6/1973 Grenzeback ..... 343/840
5,486,839 A * 1/1996 Rodeffer et al. ..... 343/786
6,137,449 A * 10/2000 Kildal ..... 343/781 P
6,864,850 B2 * 3/2005 Imaizumi et al. ..... 343/776
7,075,492 B1 * 7/2006 Chen et al. ..... 343/755
2005/0099350 A1 * 5/2005 Gothard et al. ..... 343/781 CA

FOREIGN PATENT DOCUMENTS

EP 1542310 A1 6/2005
JP 57-69901 A 4/1982
JP 59-101908 A 6/1984
JP 60-167408 A 11/1985
JP 61-12128 A 1/1986
JP 62-186506 A 11/1987

(Continued)

OTHER PUBLICATIONS

Supplementary European Search Report for EP 08 85 6740 dated Nov. 19, 2010.

(Continued)

*Primary Examiner* — Douglas W Owens
*Assistant Examiner* — Collin Dawkins

(57) ABSTRACT

Provided is a parabolic antenna that suppresses leakage of radio waves with a simpler configuration. The parabolic antenna includes a horn that transmits and receives signals; a feed that supports the horn and relays the signals the horn transmits and receives; a reflector that reflects the received signals to focus the received signals on the horn and reflects the signals from the horn to transmit the signals; a reflecting mirror supporting member that supports the reflector; and a feed fitting adapter that enables the feed to be fitted into the reflecting mirror supporting member. A choke groove is formed in at least one of a joint area between the reflecting mirror supporting member and the reflector and a joint area between the reflecting mirror supporting member and the feed fitting adapter, which suppresses propagation of radio waves traveling through the gap of the joint area.

16 Claims, 11 Drawing Sheets

(56) References Cited

FOREIGN PATENT DOCUMENTS

| | | | |
|---|---|---|---|
| JP | 2001217621 | A | 8/2001 |
| JP | 2004112660 | A | 4/2004 |
| JP | 2005091238 | A | 4/2005 |

OTHER PUBLICATIONS

International Search Report for PCT/JP2008/072150 mailed Mar. 10, 2009.
Chinese Office Action for CN200880119725 mailed on Jul. 3, 2012.

* cited by examiner

PARABOLIC ANTENNA

This application is the National Phase of PCT/JP2008/072150, filed Dec. 5, 2008, which is based upon and claims the benefit of priority from Japanese patent application No. 2007-317110, filed on Dec. 7, 2007, the disclosure of which is incorporated herein in its entirety by reference.

TECHNICAL FIELD

The present invention relates to a parabolic antenna and particularly to a parabolic antenna for reducing leakage of radio waves.

BACKGROUND ART

In a conventional assembled parabolic antenna, radio waves may leak from gaps between the surface of a reflecting mirror, a supporting member of the reflecting mirror, and a feed fitting adapter, which are components of the parabolic antenna. Due to the leakage of radio waves, if a radiation pattern standard is strict, the parabolic antenna may not be up to the standard.

Regarding the above matter, PTL 1 disclose a technique of reducing leakage of radio waves using a choke element that is formed by one portion of a case with one or more concave sections provided in the direction from a transmitting antenna to a receiving antenna.

Citation List

Patent Literature

PTL 1 JP-A-2005-91238

SUMMARY OF INVENTION

Technical Problem

If the reflecting mirror surface and the reflecting mirror supporting member are not manufactured accurately enough, the disturbance of radiation pattern caused by the leakage of radio waves from the gaps of the joint area affects the performance of antenna. In order to reduce the leakage of radio waves, the radio waves are forcibly contained by increasing the accuracy of manufacturing, covering the end portion of the joint area with a ring-shaped spring, or covering the periphery with a conductive adhesive.

Moreover, there is no mention of the applications of the technique disclosed in PTL1 to parabolic antennas: suppressing the leakage of radio waves with a plurality of frequencies or suppressing the leakage of radio waves in a broad frequency band is not expected.

Moreover, in order to reduce the leakage of radio waves in a low frequency band, the groove needs to be made deeper. However, there is a limit on the depth of the groove that can be formed by cutting.

The present invention has been made to solve the above problems. The object of the present invention is to provide a parabolic antenna that suppresses the leakage of radio waves with a simpler configuration.

Solution To Problem

According to the present invention, as means for solving the above problems, the following components are provided: a horn that transmits and receives signals; a feed that supports the horn and relays the signals the horn transmits and receives; a reflector that reflects the received signals to focus the received signals on the horn and reflects the signals from the horn to transmit the signals; a reflecting mirror supporting member that supports the reflector; and a feed fitting adapter that enables the feed to be fitted into the reflecting mirror supporting member. Moreover, a choke groove is formed in at least one of a joint area between the reflecting mirror supporting member and the reflector and a joint area between the reflecting mirror supporting member and the feed fitting adapter, which suppresses propagation of radio waves traveling through a gap of at least one of the joint areas.

Advantageous Effects Of Invention

According to the present invention, in the parabolic antenna, the choke groove is formed in at least one of the joint area between the reflecting mirror supporting member and the reflector and the joint area between the reflecting mirror supporting member and the feed fitting adapter. Therefore, the choke groove can suppress propagation of the radio waves that travel through the gap of the joint area. Thus, it is possible to reduce the leakage of radio waves with a simpler configuration.

REFERENCE SIGNS LIST

100: Parabolic antenna
101: Shroud
102: Reflector
103: Horn
104: Feed
105: Reflecting mirror supporting member
106: Feed fitting adapter
107: Choke groove

DESCRIPTION OF EMBODIMENTS

Hereinafter, exemplary embodiments of a parabolic antenna according to the present invention will be described in detail with reference to the drawings.

Figure 1:
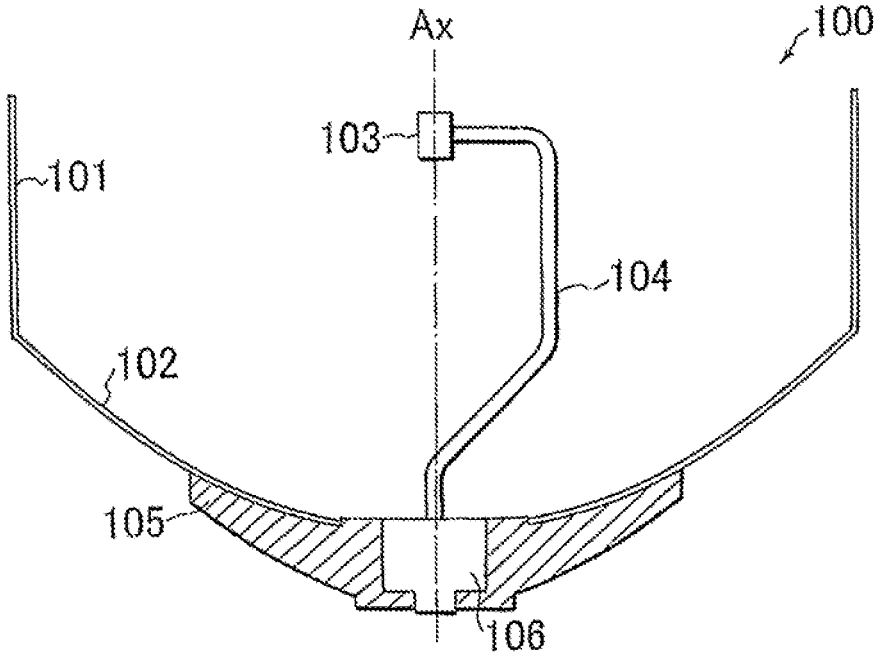
FIG. 1 A cross-sectional view illustrating the basic configuration of a parabolic antenna according to a first exemplary embodiment of the present invention.
Figure 15:
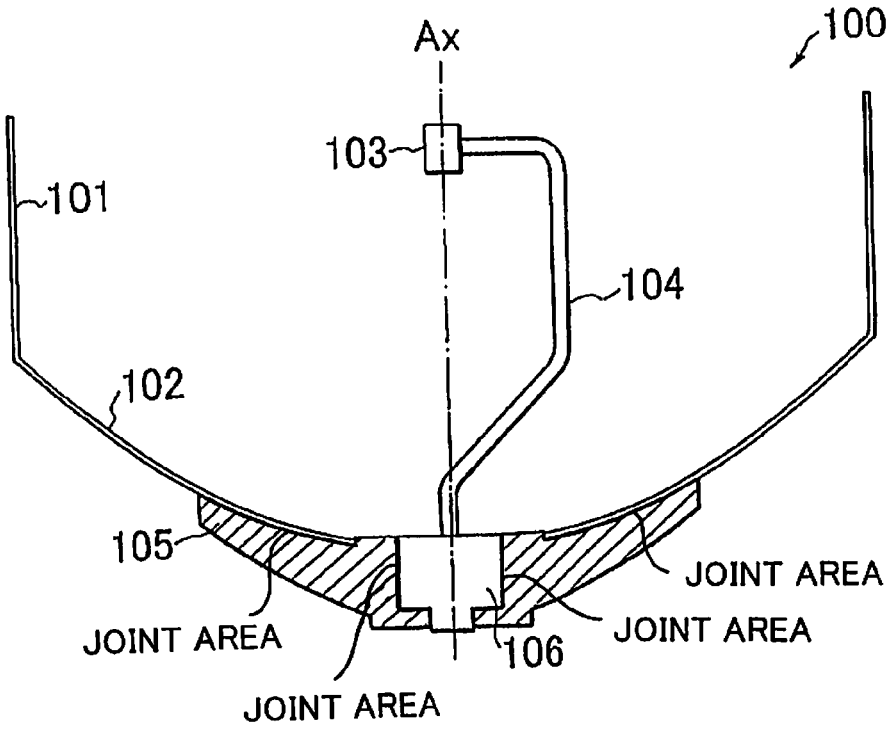
FIG. 15 A cross-sectional view illustrating the configuration which the joint areas are illustrated in FIG. 1.

[First Exemplary Embodiment]FIG. 1 is a cross-sectional view illustrating the basic configuration of a parabolic antenna according to a first exemplary embodiment of the present invention. FIG. 15 is a cross-sectional view illustrating the configuration which joint areas are illustrated in FIG. 1.

As shown in FIG. 1, the parabolic antenna 100 of the present exemplary embodiment is used, for example, as a transmitting/receiving antenna for a communication device (not shown). The basic configuration of the parabolic antenna 100 has a shroud 101, a reflector 102, a horn 103, a feed 104, a reflecting mirror supporting member (also referred to as "backup structure" or the like) 105, and a feed fitting adapter 106 (In FIG. 1, the choke grooves described below are omitted for reasons of explanation).

The shroud 101 is attached to the front side of the reflector 102, keeping radio waves from being radiated behind the parabolic antenna 100. The reflector 102 has a reflecting surface (parabolic mirror surface) on which a curve of rotational parabolic surface is formed. The reflecting surface focuses the received signals on the horn 103 and also reflects signals transmitted from the horn 103. The horn 103 is disposed along a central axis Ax of the reflector 102 on the focal point side. The horn 103 transmits and receives signals. The feed 104 is disposed on the front side of the reflector 102 so as to go around the central axis Ax and extend toward the focal point side, and supports the horn 103 attached to the tip side. The feed 104 transmits signals to the horn 103 and signals received by the horn 103 to the main unit side in order to relay signals. The reflecting mirror supporting member 105 is disposed behind the reflector 102 to support the reflector 102. The feed fitting adapter 106 enables the feed 104 to be fitted into the reflecting mirror supporting member 105 and is disposed behind the reflector 102 along the central axis Ax.

Figure 2:
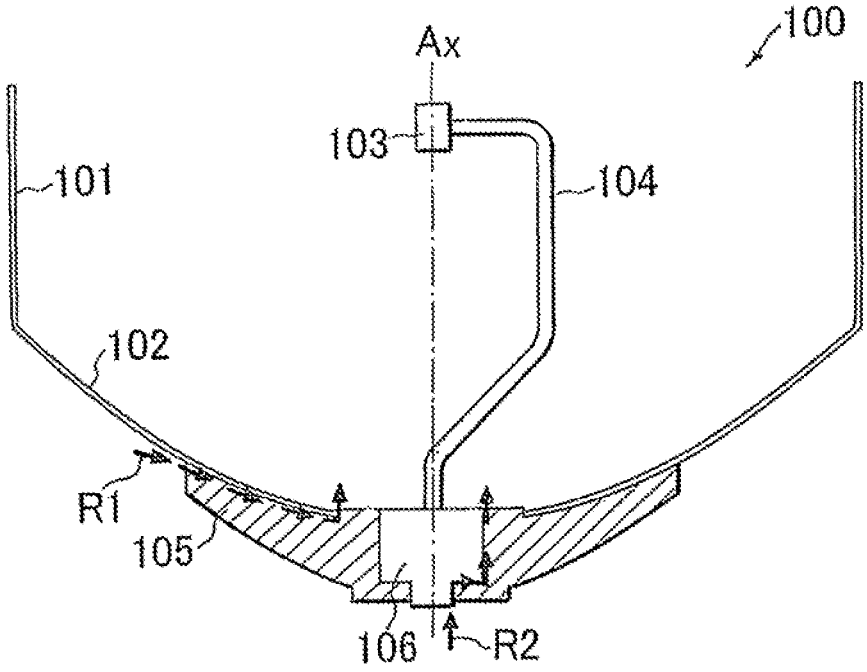
FIG. 2 A cross-sectional view illustrating a route along which radio waves leak in the rear surface side of the parabolic antenna of FIG. 1.

FIG. 2 is a cross-sectional view illustrating a route along which radio waves leak in the parabolic antenna 100 illustrated in FIG. 1 (In FIG. 2, the choke grooves described below are omitted for reasons of explanation). As shown in FIG. 2, when radio waves are received, the radio waves that have entered from the back side (rear surface) of the parabolic antenna 100 travel through a gap of a joint area between the reflecting mirror supporting member 105 and the reflector 102 and a gap of a joint area between the reflecting mirror supporting member 105 and the feed fitting adapter 106, and leak in the propagation directions of radio wave leakage routes R1 and R2 as indicated by arrow in the diagram. When radio waves are transmitted, the radio waves that have entered from the front side (front surface) of the parabolic antenna 100 leak, traveling along the routes in the directions opposite to the propagation directions of the radio wave leakage routes R1 and R2 of the signals received.

Figure 3:
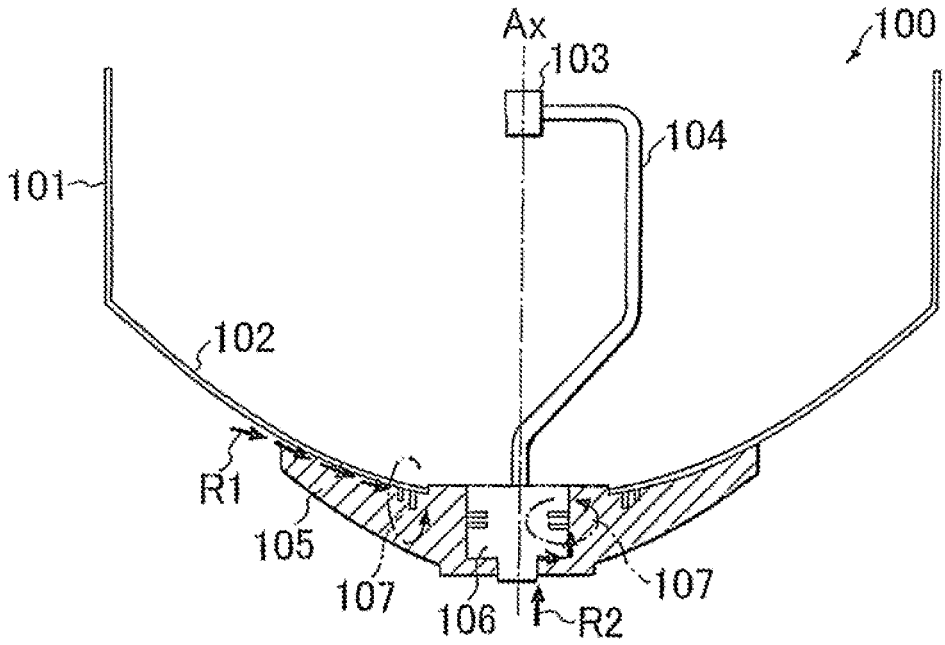
FIG. 3 A cross-sectional view detailing the configuration of the parabolic antenna of FIG. 1.

FIG. 3 is a cross-sectional view detailing the configuration of the parabolic antenna 100 according to the present exemplary embodiment. As shown in FIG. 3, according to the present exemplary embodiment, for the radio wave leakage route R1, choke grooves 107 are formed in the joint area between the reflecting mirror supporting member 105 and the reflector 102 on the side of the reflecting mirror supporting member 105 in order to suppress propagation of radio waves traveling through the gap of the joint area. For the radio wave leakage route R2, choke grooves 107 are formed in the joint area between the reflecting mirror supporting member 105 and the feed fitting adapter 106 on the side of the feed fitting adapter 106 in order to suppress propagation of radio waves traveling through the gap of the joint area.

That is, the choke grooves 107 are so formed as to go across, in the directions perpendicular to the propagation directions or other directions, the propagation directions of the radio waves travelling along the radio wave leakage routes R1 and R2. When seen from the front side of the parabolic antenna 100, the choke grooves 107 formed on the reflecting mirror supporting member 105 for the radio wave leakage route R I are formed circularly or concentrically around the feed fitting adapter 106. The choke grooves 107 formed on the feed fitting adapter 106 for the radio wave leakage route R2 are so formed as to circle around the periphery of the feed fitting adapter 106.

As shown in FIG. 3, when radio waves are received, the choke grooves 107 suppress propagation of the radio waves that have entered from the back side of the parabolic antenna 100. Therefore, the radio waves do not go beyond the choke grooves 107. When radio waves are transmitted, the choke grooves 107 suppress propagation of the radio waves that have entered from the front side of the parabolic antenna 100. Therefore, the radio waves do not go beyond the choke grooves 107.

Figure 4:
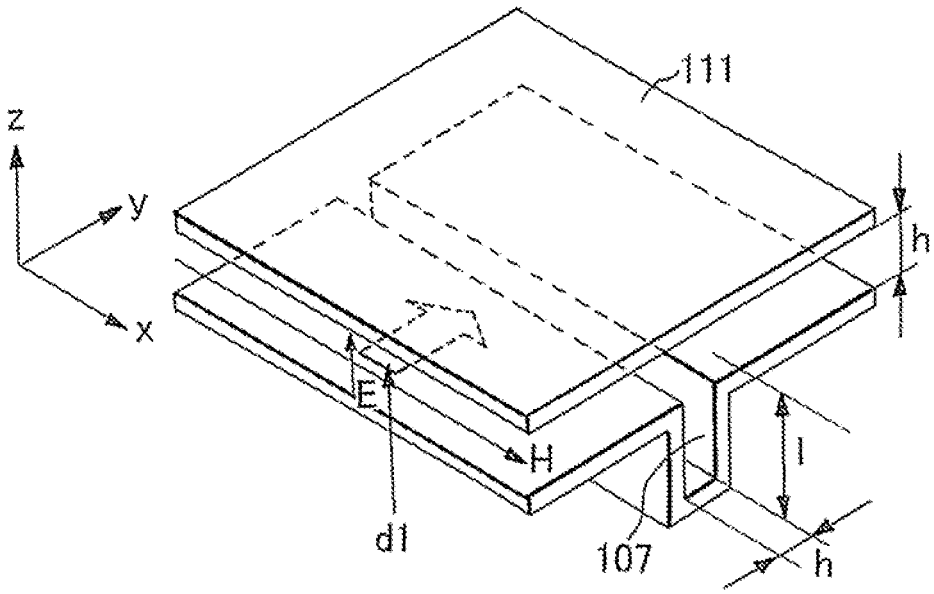
FIG. 4 A diagram illustrating the principle of how choke grooves of FIG. 3 suppress propagation of radio waves.
Figure 5:
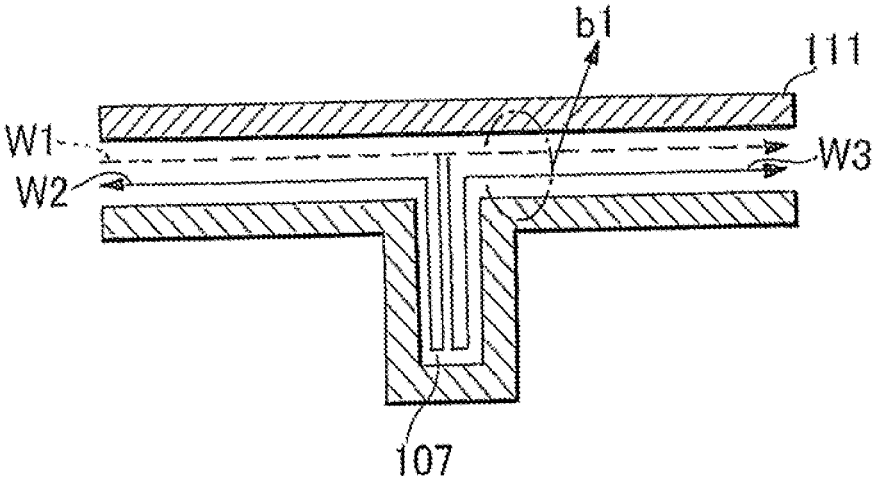
FIG. 5 A diagram illustrating the principle of how the choke grooves of FIG. 3 suppress propagation of radio waves.

FIGS. 4 and 5 are diagrams illustrating the principle of how the choke grooves 107 suppress propagation of radio waves.

FIGS. 4 and 5 illustrate radio waves traveling along a waveguide (parallel plate line) between conducting plates 111 with a height of h. On one portion of the conducting plate 111, the choke groove 107 is formed with a height of h and a depth 1 from the midpoint between the conducting plates 11. If there is no choke groove 107, a radio wave that has entered the waveguide travels in a propagation direction dl as illustrated in FIG. 4 without being reflected (In FIG. 4, E and H represent an electric field and a magnetic field, respectively). If there is the choke groove 107, a radio wave W1 that has entered the waveguide between the conducting plates 111 makes a turn at the crossing portion toward the choke groove 107 and is reflected at the bottom of the choke groove 107. The reflected waves W2 and W3 go upward in the choke groove 107 traveling in the opposite direction.

If the depth of the choke groove 107 is about the wavelength of the radio wave divided by four and multiplied by an odd number, the phase of the reflected waves W2 and W3 reflected at the bottom of the choke groove 107 is opposite to that of the incident wave WI. Accordingly, the reflected waves W2 and W3 of the opposite phase and the incident wave W1 interfere with and cancel out each other. Therefore, the waves do not go beyond the choke groove 107 in the waveguide. The portion b1 of the diagram schematically illustrates how the incident wave W1 and the reflected wave W3 of the opposite phase and same amplitude interfere with and cancel out each other.

If the waveguide between the conducting plates 111 is used in a way that allows only the passage of a basic mode, the waveguide appears to be electrically short-circuited at points that are spaced at intervals of one-half of the wavelength in the waveguide from a short circuit portion of the choke groove 107 when seen from the incident side. In view of standing wave distribution, it can be assumed that the waveguide is short-circuited at the points. The reason is that only the basic mode goes on in the linear portion of the waveguide; however, it is not exactly correct to say so because slightly complicated distribution appears where the waveguide and the choke groove 107 are connected.

Here is a description of how a transmitted wave becomes smaller when the depth 1 of the choke groove 107 is one-fourth of the wavelength qualitatively. Described first here is how the phase of the reflected wave that reaches the crossing portion from the choke groove 107 changes with respect to the phase of the incident wave that has reached the crossing portion where the waveguide and the choke groove 107 cross each other.

Since the depth 1 is one-fourth of the wavelength, the phase delay is one-half of the wavelength, or 180 degrees, of which one-half comes with the wave getting into the choke groove 107 and another half with the wave coming out of the choke groove 107. Moreover, the phase is delayed by 180 degrees when reflected because the choke groove 107 is a short circuit end point. Therefore, the phase is delayed by 360 degrees in total after the wave is reflected. That is, the incident wave is in phase with the reflected wave when joining the reflected wave. In this case, it appears likely that the transmitted wave is also added in phase with the reflected wave, but not.

Figure 6A:
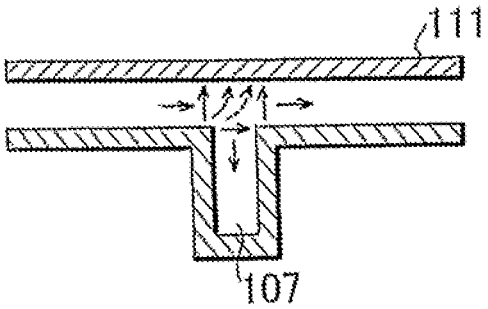
FIG. 6 (FIGS. 6A and 6B) Schematic cross-sectional views illustrating how a transmitted wave is made smaller by the choke groove of FIGS. 4 and 5.
Figure 6B:
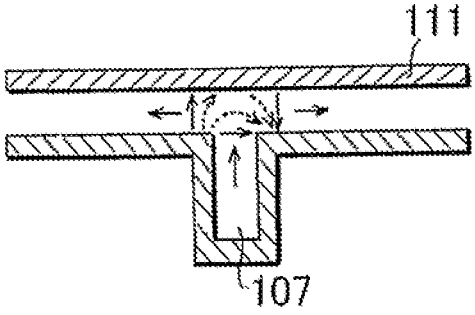

FIG. 6 is a schematic cross-sectional view illustrating how the transmitted and reflected waves cancel out each other and become smaller in the above case. The dotted arrows in FIGS. 6A and 6B show the behavior of an electric field when a wave enters the crossing portion of the waveguide and choke groove 107. FIG. 6B shows how the reflected wave from the choke groove 107 returns to the waveguide.

When the reflected wave from the choke groove 107 returns to the waveguide, the phase of the wave in the left portion of the waveguide is 180 degrees different from that in the right portion of the waveguide, which is on the opposite side of the choke groove 107 from the left portion. Accordingly, even if the incident wave that has returned to the crossing portion of the waveguide and choke groove 107 after being reflected is in phase with the original wave, the phase of the incident wave is opposite to that of the transmitted wave in the portion of the waveguide (the right side of the diagram) beyond the choke groove 107. In that manner, the transmitted wave is canceled out by the reflected wave of the opposite phase and same amplitude in the portion of the waveguide beyond the choke groove 107. Therefore, the choke groove 107 suppresses propagation of the radio wave traveling along the waveguide, thereby suppressing the leakage of the radio wave.

Figure 7:
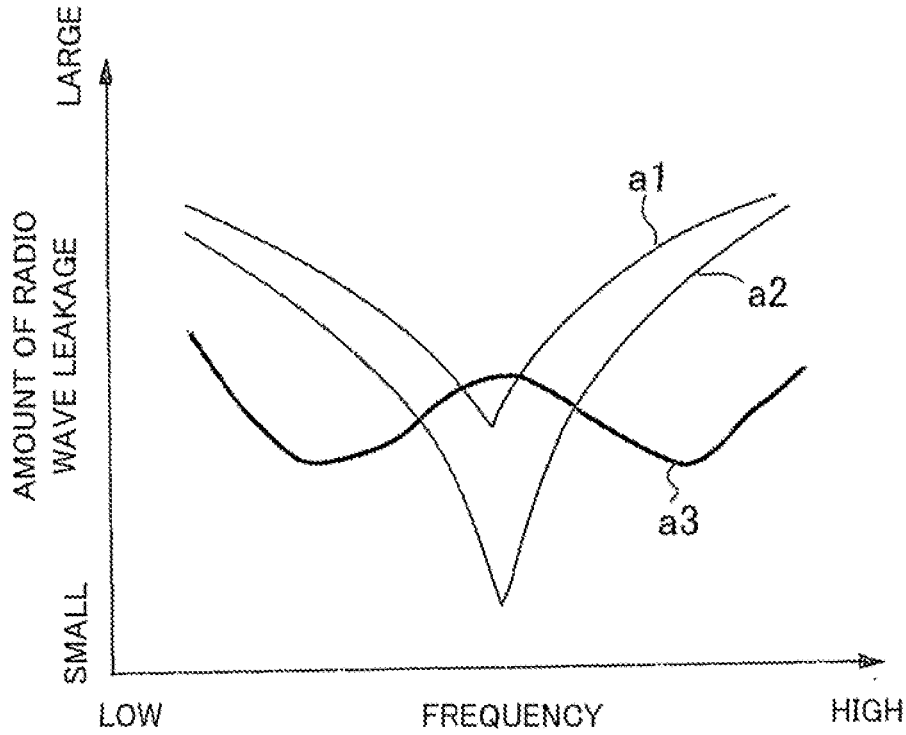
FIG. 7 A graph illustrating a frequency characteristic about the amount of radio wave leakage in the parabolic antenna of FIG. 3.

FIG. 7 is a graph illustrating a frequency characteristic about the amount of radio wave leakage (Horizontal axis: frequency, Vertical axis: amount of radio wave leakage). In FIG. 7, a1 shows the case of one choke groove 107, a2 the case of two choke grooves 107 of the same depth, a3 the case of two choke grooves 107 of different depths and widths. In each case, as shown in FIG. 7, the amount of radio wave leakage decreases in a predetermined frequency range.

Figure 8:
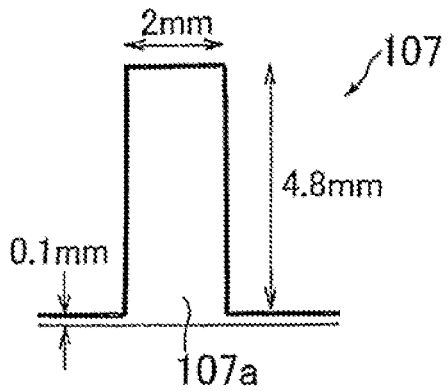
FIG. 8 A partial cross-sectional view illustrating a choke groove with a width of approximately 2 mm and a depth of around 4.8 mm provided on the joint area of FIG. 3.

FIG. 8 is a partial cross-sectional view illustrating a choke groove 107*a* with a width of approximately 2 mm and a depth of around 4.8 mm provided on the joint area (which has a gap with a width of around 0.1 mm) of FIG. 3. In this case, when seen from the front side of the parabolic antenna 100, the choke groove 107*a* is circularly formed around the feed fitting adapter 106.

Figure 9:
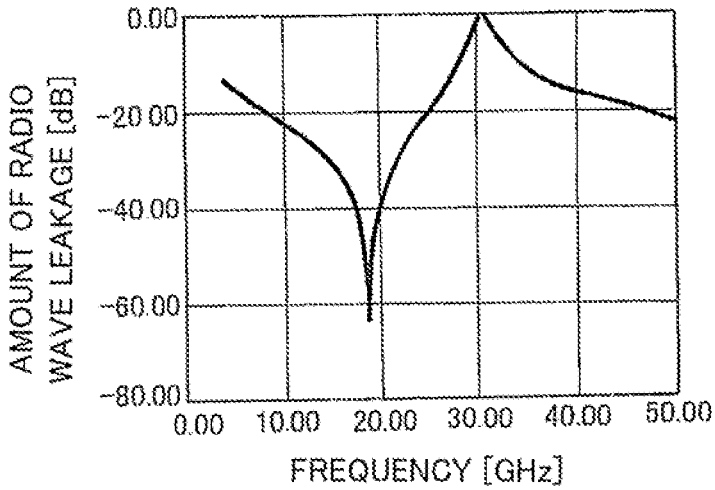
FIG. 9 A graph showing the results of simulation of a radio wave leakage state when the choke groove of FIG. 8 is used.

FIG. 9 is a graph showing the results of simulation of a radio wave leakage state when the choke groove 107*a* of FIG. 8 is used (Horizontal axis: frequency [GHz], Vertical axis: amount of radio wave leakage [dB]). As shown in FIG. 9, when the choke groove 107*a* is used, the amount of radio wave leakage decreases for radio waves with a frequency of about 18 GHz; it is clear that a leakage suppression effect takes place.

The above configuration can be applied to the following cases: the case in which a plurality of choke grooves 107 of the same width and depth are arranged side by side, and the case in which a plurality of choke grooves of different widths and depths are arranged side by side. Incidentally, as for where and how the choke grooves 107 are formed, like those in the first exemplary embodiment, the choke grooves 107 are so formed as to go across, in the directions perpendicular to the propagation directions or other directions, the propagation directions of the radio waves travelling along the radio wave leakage routes R1 and R2.

Figure 10:
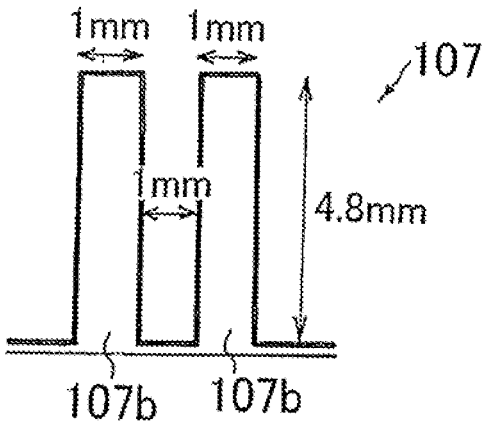
FIG. 10 A partial cross-sectional view illustrating a plurality of choke grooves with a width of about 1 mm and a depth of around 4.8 mm arranged side by side on the joint area of FIG. 3.

FIG. 10 is a partial cross-sectional view illustrating a plurality of choke grooves 107*b* (two in the example of the diagram) with a width of about 1 mm and a depth of around 4.8 mm arranged side by side at intervals of approximately 1 mm on the joint area of FIG. 3. In this case, when seen from the front side of the parabolic antenna 100, a plurality of choke grooves 107*b* are concentrically formed around the feed fitting adapter 106 at different positions in the radial direction.

Figure 11:
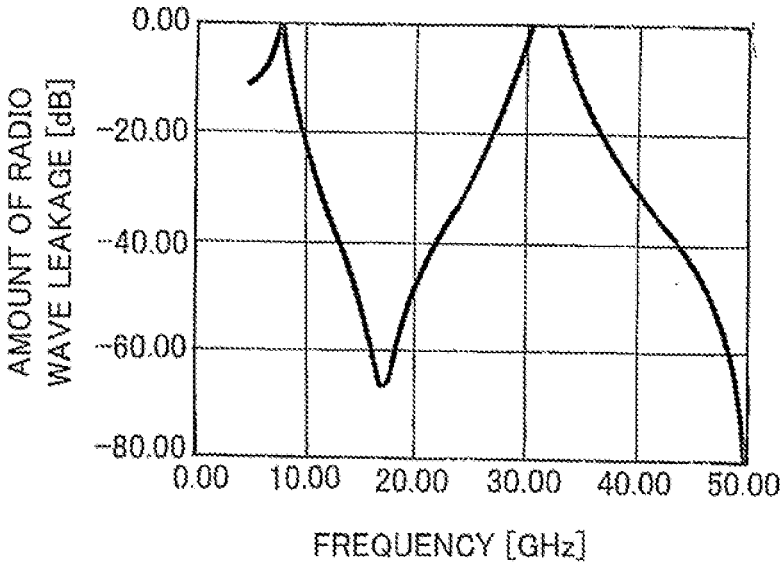
FIG. 11 A graph showing the results of simulation of a radio wave leakage state when the choke grooves of FIG. 10 are used.

FIG. 11 is a graph showing the results of simulation of a radio wave leakage state when the choke grooves 107*b* of FIG. 10 are used (Horizontal axis: frequency [GHz], Vertical axis: amount of radio wave leakage [dB]). Even in this case, as shown in FIG. 11, the amount of radio wave leakage decreases for radio waves with a frequency of about 18 GHz; it is clear that a leakage suppression effect takes place. In this case, compared with the case illustrated in FIG. 9, the sharpness of graph is smaller, meaning that, in the graph, a radio wave's frequency range becomes broader. Compared with the case illustrated in FIG. 9, the amount of radio wave leakage decreases for radio waves in a broader frequency band; it is clear that a leakage suppression effect takes place.

Figure 12:
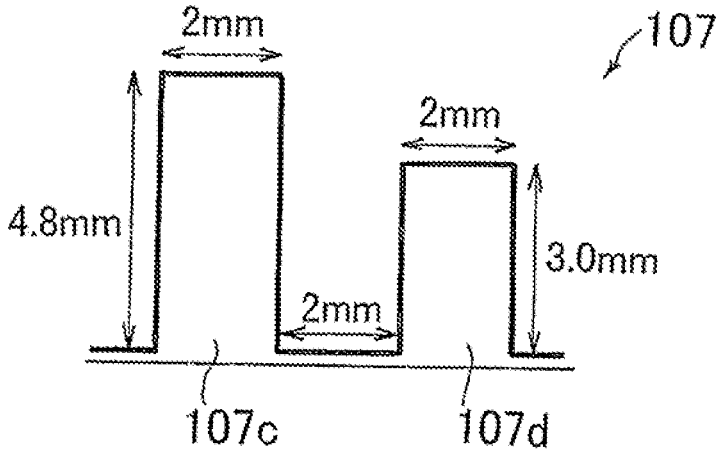
FIG. 12 A partial cross-sectional view illustrating a choke groove with a width of about 2 mm and a depth of around 4.8 mm and a choke groove with a width of about 2 mm and a depth of around 3.0 mm arranged side by side on the joint area of FIG. 3.

FIG. 12 is a partial cross-sectional view illustrating a choke groove 107*c* (first choke groove) with a width of about 2 mm and a depth of around 4.8 mm and a choke groove 107*d* (second choke groove) with a width of about 2 mm and a depth of around 3.0 mm arranged side by side at an interval of approximately 2 mm on the joint area of FIG. 3. In this case, the depths of two choke grooves 107*c* and 107*d* are in the ratio of about 4.8 mm to 3.0 mm, i.e. about 8 to 5. In this case, when seen from the front side of the parabolic antenna 100, a plurality of choke grooves 107*c* and 107*d* are concentrically formed around the feed fitting adapter 106 at different positions in the radial direction.

Figure 13:
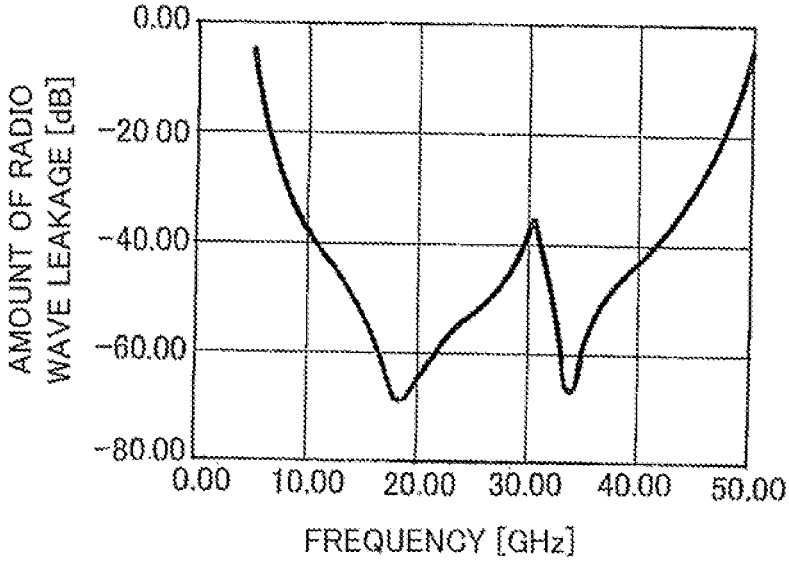
FIG. 13 A graph showing the results of simulation of a radio wave leakage state when the choke grooves of FIG. 12 are used.

FIG. 13 is a graph showing the results of simulation of a radio wave leakage state when the choke grooves 107*c* and 107*d* of FIG. 12 are used (Horizontal axis: frequency [GHz], Vertical axis: amount of radio wave leakage [dB]). As shown in FIG. 13, the amount of radio wave leakage decreases in a frequency range of 10 GHz to 40 GHz; it is clear that a leakage suppression effect takes place.

In particular, since the choke groove 107*d* with a depth of about 3.0 mm is added to one choke groove 107*c* with a depth of about 4.8 mm illustrated in FIG. 8, the amount of radio wave leakage decreases even for radio waves with a frequency of about 34 GHz and a leakage suppression effect is obtained. At the same time, as the band of the radio waves becomes broader, the amount of radio wave leakage also decreases for radio waves in a lower frequency range below approximately 18 GHz and a leakage suppression effect is obtained, meaning that a radio wave leakage suppression effect is obtained without the choke groove 107 with a depth of 4.8 mm or more that corresponds to a frequency of about 18 GHz or less. Therefore, the above structure is effective in providing the choke groove 107 when there is a limit on the thickness of materials of the components.

As described above, according to the present exemplary embodiment, the choke groove 107 is so formed as to go across the leakage routes R1 and R2 of the parabolic antenna 100; the depth of the choke groove 107 is set equal to about the wavelength of the radio wave divided by four and multiplied by an odd number.

Radio waves enter from the back side of the parabolic antenna 100 when the radio waves are received, or from the front side of the parabolic antenna 100 when the radio waves are transmitted, and travel through the gap of each joint area. The choke groove 107 effectively prevents such radio waves from further traveling beyond the choke groove 107. Therefore, it is possible to further reduce the leakage of radio waves.

In particular, when a plurality of choke grooves 107 are provided, the choke grooves 107 each effectively keep the radio waves in a broader frequency band that travel through the gaps of the joint areas from going beyond the choke grooves 107. Therefore, it is possible to widen a frequency range of radio waves to be cut off.

Moreover, when a plurality of choke grooves 107 of different depths are provided, the above effect is obtained. In addition, the choke grooves 107 each effectively prevent the radio waves of different frequencies that travel through the gaps of the joint areas from further traveling beyond the choke grooves 107. Therefore, it is possible to reduce the leakage of radio waves of different frequencies.

In the above case, it is possible to provide, as a plurality of choke grooves 107, a first choke groove 107 designed to suppress propagation of a radio wave of first frequency (high frequency wave) and a second choke groove 107 designed to suppress propagation of a radio wave of second frequency (low frequency wave), which is lower than the first frequency. Incidentally, not only grooves of different depths, but also those of different widths or in different shapes and the likes may be provided as a plurality of choke grooves 107.

In the above embodiment, the following choke grooves are described: the choke groove 107 whose depth is set at about the wavelength of a radio wave divided by four and multiplied by an odd number in order to reduce the leakage of the radio wave; a plurality of choke grooves 107 with at least one groove having a depth of about 4.8 mm or 3.0 mm; and a plurality of choke grooves 107 with the depths of two grooves in the ratio of about 8 to 5. However, the present invention is not limited to the above choke grooves. Any kinds of choke groove can be applied as long as the grooves can obtain a radio wave leakage suppression effect like the one described above.

Moreover, described in the above embodiment are the choke grooves 107 that are so formed as to circle around the periphery of the feed fitting adapter 106, when the choke grooves 107 are formed circularly or concentrically around the feed fitting adapter 106 on the reflecting mirror supporting member 105. However, the present invention is not limited to the above choke groove. Any kinds of choke groove can be applied as long as the grooves can obtain a radio wave leakage suppression effect like the one described above.

[Second Exemplary Embodiment]

Figure 14:
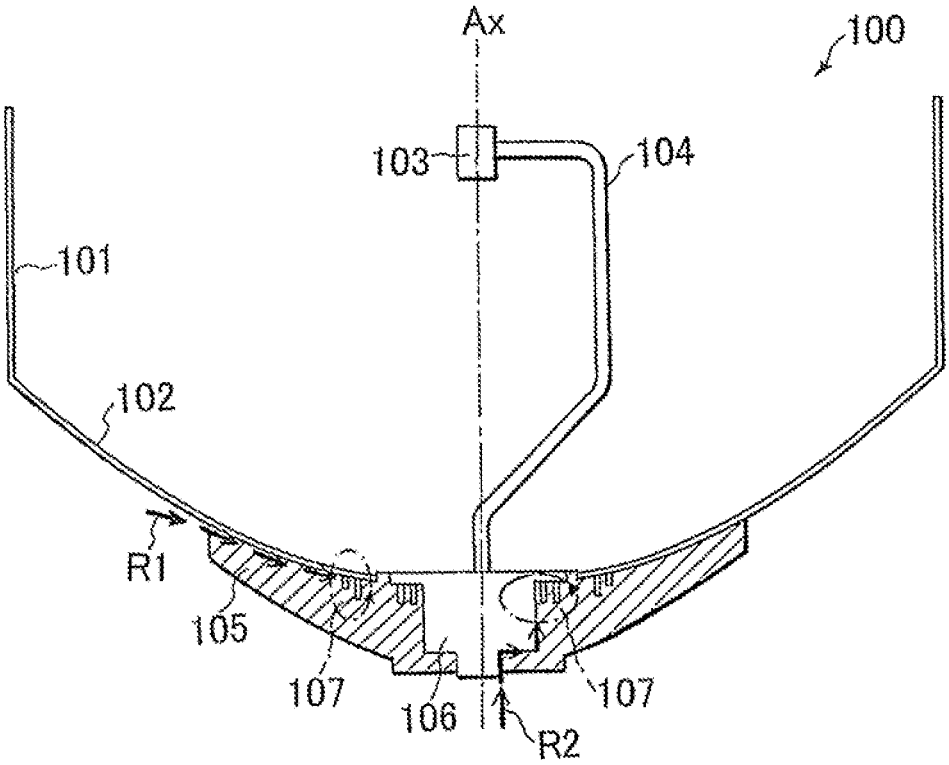
FIG. 14 A cross-sectional view detailing the configuration of a parabolic antenna according to a second exemplary embodiment of the present invention.

FIG. 14 is a cross-sectional view detailing the configuration of a parabolic antenna according to a second exemplary embodiment of the present invention.

As shown in FIG. 14, according to the present exemplary embodiment, like the first exemplary embodiment, the configuration of the parabolic antenna 100 has the shroud 101, the reflector 102, the horn 103, the feed 104, the reflecting mirror supporting member 105, and the feed fitting adapter 106. However, the way the choke grooves 107 for the radio wave leakage route R2 are formed is different. That is, as shown in FIG. 14, the choke grooves 107 for the radio wave leakage route R1 are formed, like those in the first exemplary embodiment, in the joint area between the reflecting mirror supporting member 105 and the reflector 102 on the side of the reflecting mirror supporting member 105. On the other hand, the choke grooves 107 for the radio wave leakage route R2 are formed in the joint area between the reflecting mirror supporting member 105 and the feed fitting adapter 106 on the side of the reflecting mirror supporting member 105, not on the side face of the feed fitting adapter 106; the choke grooves 107 are arranged side by side circularly or concentrically around the feed fitting adapter 106. Even in this case, the same operation and effect as in the first exemplary embodiment are obtained.

Incidentally, described in the first and second exemplary embodiments are the choke grooves 107 provided in the joint area between the reflecting mirror supporting member 105 and the reflector 102 and in the joint area between the reflecting mirror supporting member 105 and the feed fitting adapter 106. However, the present invention is not limited to the above choke grooves 107. It is also possible to provide the choke grooves 107 in at least one of the joint areas.

In an application example, the above parabolic antenna 100 can be applied to a communication device that uses the parabolic antenna 100 as a transmitting/receiving antenna, a communication network that has a plurality of communication devices as, for example, network terminal devices and relay devices, or the like.

While the invention has been particularly shown and described with reference to exemplary embodiments thereof, the invention is not limited to these embodiments. It will be understood by those of ordinary skill in the art that various changes in form and details may be made therein without departing from the sprit and scope of the present invention as defined by the claims.

INDUSTRIAL APPLICABILITY

The present invention can be applied to parabolic antennas, other antennas and communication devices using the antennas. The present invention can be also applied to the packaging structures of various devices requiring shields, and the like.

The invention claimed:

1. A parabolic antenna comprising:

a horn that transmits and receives signals;

a feed that supports the horn and relays the signals the horn transmits and receives;

a reflector that reflects the received signals to focus the received signals on the horn and reflects the signals from the horn to transmit the signals;

a reflecting mirror supporting member that supports the reflector; and a feed fitting adapter that enables the feed to be fitted into the reflecting mirror supporting member, wherein a choke groove is formed in at least one of the reflecting mirror supporting member in a joint area between the reflecting mirror supporting member and the reflector, and the reflecting mirror supporting member or the feed fitting adapter in a joint area between the reflecting mirror supporting member and the feed fitting adapter.

2. The parabolic antenna according to claim 1, wherein the choke groove is formed as a plurality of choke grooves.

3. The parabolic antenna according to claim 2, wherein the plurality of choke grooves include a choke groove that is different in shape.

4. The parabolic antenna according to claim 3, wherein the plurality of choke grooves include a choke groove that is different in depth.

5. The parabolic antenna according to claim 3, wherein the plurality of choke grooves include a first choke groove that suppresses propagation of a radio wave of first frequency and a second choke groove that suppresses propagation of a radio wave of second frequency that is lower than the first frequency.

6. The parabolic antenna according to claim 2, wherein the plurality of choke grooves are arranged side by side.

7. The parabolic antenna according to claim 2, wherein at least one of the plurality of choke grooves is about 4.8 mm in depth.

8. The parabolic antenna according to claim 2, wherein at least one of the plurality of choke grooves is about 3.0 mm in depth.

9. The parabolic antenna according to claim 2, wherein the depths of two of the plurality of choke grooves are in the ratio of about 8 to 5.

10. The parabolic antenna according to claim 9, wherein the choke groove suppresses propagation of radio waves of a frequency greater than or equal to 10 GHz and less than or equal to 40 GHz.

11. The parabolic antenna according to claim 1, wherein the depth of the choke groove is set equal to about the wavelength of the radio wave divided by four and multiplied by an odd number to suppress propagation of the radio wave.

12. The parabolic antenna according to claim 1, wherein the choke groove is circularly formed around the feed fitting adapter on the reflecting mirror supporting member.

13. The parabolic antenna according to claim 2, wherein the choke groove is concentrically formed around the feed fitting adapter on the reflecting mirror supporting member.

14. The parabolic antenna according to claim 1, wherein the choke groove is so formed as to circle around the periphery of the feed fitting adapter.

15. The parabolic antenna according to claim 1, wherein the choke groove is formed in a predetermined direction with respect to a propagation direction of the radio waves traveling through the gap of at least one of the joint areas and is of a predetermined depth.

16. A communication device comprising the parabolic antenna of claim 1.

* * * * *